United States Patent [19]

Iwasaki

[11] 4,432,323

[45] Feb. 21, 1984

[54] IGNITION SYSTEM

[75] Inventor: Shinichiro Iwasaki, Troy, Mich.

[73] Assignee: Aisin Seiki Kabushiki Kaisha, Kariya, Japan

[21] Appl. No.: 455,574

[22] Filed: Jan. 4, 1983

Related U.S. Application Data

[62] Division of Ser. No. 268,889, Jun. 1, 1981, Pat. No. 4,382,430.

[51] Int. Cl.[3] ..... F02P 1/00

[52] U.S. Cl. ..... 123/427; 123/606; 123/621; 123/643

[58] Field of Search ..... 123/414, 418, 427, 606, 123/607, 608, 621, 622, 636, 637, 643, 613

[56] References Cited

U.S. PATENT DOCUMENTS

| | | | |
|---|---|---|---|
| 4,170,209 | 10/1979 | Petrie et al. | 123/609 |
| 4,366,801 | 1/1983 | Endo et al. | 123/606 X |
| 4,369,758 | 1/1983 | Endo | 123/606 X |

*Primary Examiner*—Tony M. Argenbright

*Attorney, Agent, or Firm*—Oblon, Fisher, Spivak, McClelland & Maier

[57] ABSTRACT

An ignition system for an internal combustion engine is disclosed which includes a separate ignition transformer for each spark plug in the engine. Each of the ignition transformers is enabled by means of signals produced by a crankshaft position sensor. Pulsating DC currents are then caused to flow in the primary windings of the ignition transformer thereby inducing a high voltage into a secondary winding of the transformer. A combination ignition transformer and spark plug cover is also disclosed.

3 Claims, 11 Drawing Figures

IGNITION SYSTEM

This is a division, of application Ser. No. 268,889, filed June 1, 1981, now U.S. Pat. No. 4,382,430.

BACKGROUND OF THE INVENTION

1. Field of the Invention

The present invention relates in general to a novel ignition system and in particular to a novel ignition system for use with internal combustion engines.

2. Description of the Prior Art

Conventional ignition systems for internal combustion engines have proven themselves to be reliable and adequate for many years. In recent times these systems have been upgraded by means of various electronic switching apparatus. However, even with the addition of the electronic apparatus, the systems remain very similar in operation to the conventional electromechanical systems.

Modern engines are required to meet a multitude of ever tightening standards regarding the quantity and quality of exhaust emissions. In order to meet these requirements, engine manufacturers have resorted to producing engines which operate under very lean air to fuel mixtures and engines which employ stratified charge or tubulant flow technology. Lean burning engines require increased spark duration for proper operation. This is accomplished in the conventional systems by increasing the open circuit spark voltage. However, increasing the voltage results in an increase in the amplitude as well as the duration of the spark current which greatly decreases the life of the spark plugs. In turbulant flow-type systems, the flow of the charge within the individual cylinders of the engine tends to blow out or extinguish the arc occuring within the spark plug prematurely thereby decreasing the duration of the spark which is detrimental to proper ignition.

The present invention is directed to a novel AC ignition system which produces an alternating current and therefore an intermittent spark within the spark plug. In such an AC system, the duration of the ignition can be greatly increased over that of the conventional systems without a corresponding decrease in spark plug life. Also, since the total ignition comprises a plurality of short intermittent sparks, the blow out problems of turbulant flow engines are greatly reduced.

Another problem inherent in conventional designs is that they generally use a common high voltage generator in the form of a single ignition coil for all the spark plugs in the engine. The high voltage from the single coil is then distributed to the various plugs by means of a rotary high voltage switch or distributor and a system of high voltage cables. The distribution and high voltage cables are well known to be frequent sources of problems and thus are the weak links in the conventional system.

The present invention is directed to a novel ignition system which overcomes the difficulties inherent in the conventional systems utilizing a common high voltage generator by providing an essentially independent high voltage generator system for each spark plug in the engine. An individual ignition transformer is provided for each spark plug. In a preferred embodiment, each ignition transformer is built into a novel spark plug cover which thus acts to eliminate the need for high voltage wiring. The distributor of the conventional system is also electronically eliminated.

SUMMARY OF THE INVENTION

Accordingly, one object of the present invention is to provide a novel AC ignition system wherein the duration of the ignition can be increased over that of a conventional system without decreasing the life of the spark plugs.

Another object of the present invention is to provide a novel AC ignition system which eliminates the need for a high voltage distribution system.

Still another object is to provide a novel ignition system wherein a separate high voltage generator is provided for each spark plug in the engine.

Yet another objective is to provide a novel ignition transformer and spark plug cover assembly wherein the ignition transformer surrounds the spark plug and is enclosed in a cover which includes connectors for the spark plug.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
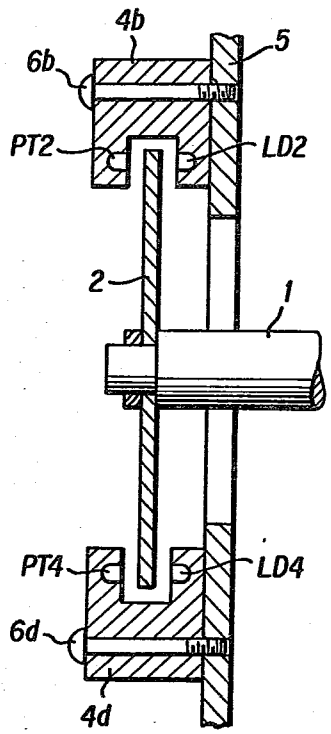
FIG. 2 is a cross-sectional side view of the rotational position sensor shown in FIG. 1.

Referring now to the drawings, wherein like reference numerals designate identical or corresponding parts throughout the several views, and more particularly to FIGS. 1–6 thereof, a first preferred embodiment of an ignition system according to the present invention is illustrated.

Figure 1:
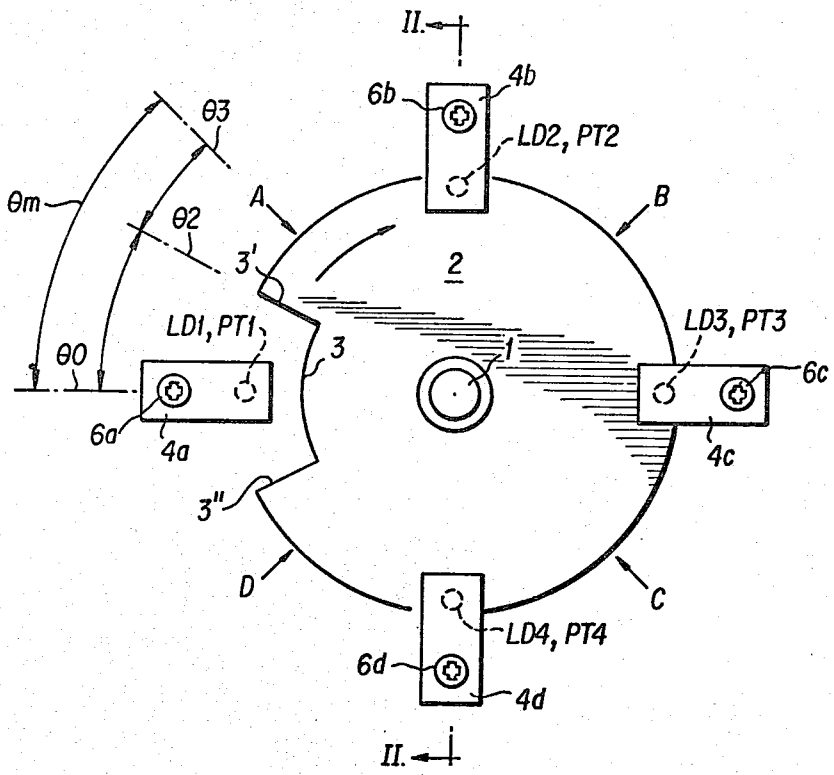
FIG. 1 is a plan view of a rotational position sensor.

FIG. 1 illustrates a plan view and FIG. 2 illustrates a sectional view taken along line II—II in FIG. 1 of a crankshaft position sensor which includes a shaft 1 coupled to rotate in synchronism with the crankshaft of a four cylinder engine (not illustrated). Coupled to and rotating therewith is a circular shutter 2 having a segmented opening 3 in its circumferential edge. The shutter 2 is shown as rotating clockwise in the direction of the arrow shown in FIG. 1.

Positioned about the shutter 2 are four photo-interrupters 4*a* through 4*d* which are attached to a stationary member 5 of the engine by means of fasteners 6*a* through 6*d*, respectively. As best seen in FIG. 2, the shutter 3 passes through an open portion of each photo-interrupter. Located at one side of each opening in the photo-interrupters 4*a* through 4*d* are light emitting diodes LD1 through LD4, respectively, which act as constant light sources. Positioned on the opposite side of each opening are photo-transistors PT1 through PT4, respectively. The shutter 2 is positioned to pass between each pair of light emitting diodes and photo-transistors such that the passage of the segmented opening through each photo-interrupter 4*a* through 4*d* may be detected. Thus in FIG. 1, when the leading edge 3′ of the opening 3 of the shutter 2 passes through the center of the photo-interrupter 4*a*, the phototransmitter PT1 receives light from the light emitting diode LD1 and becomes turned on. The photo-transistor PT1 remains on until the trailing edge 3″ of the opening 3 passes through the center of the photo-interrupter. A similar action takes place within the other photo-interrupters 4*b* through 4*d*. The outputs of the photo-interrupter 4*a* through 4*d* are utilized to provide firing signals for the ignition system of the present invention.

Figure 3A:
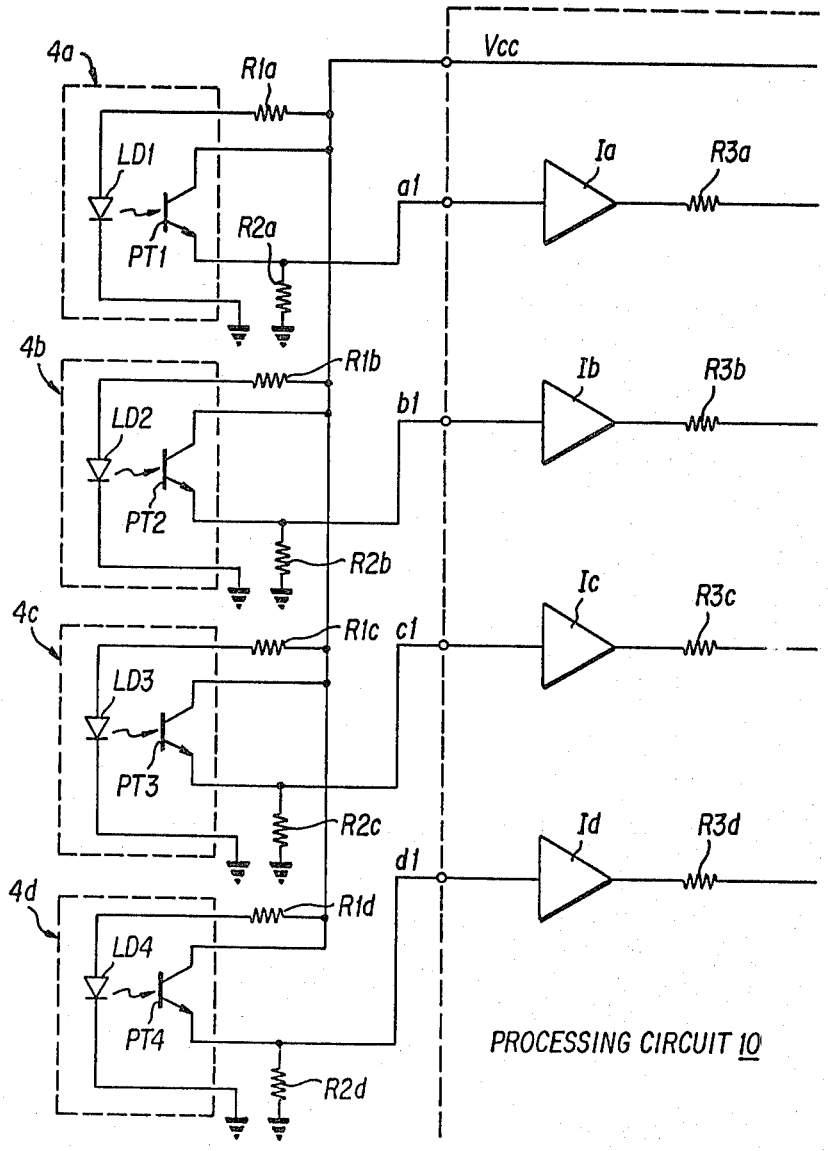
FIGS. 3*a*, 3*b* and 4 illustrate a first preferred embodiment of an ignition system according to the present invention.
Figure 3:
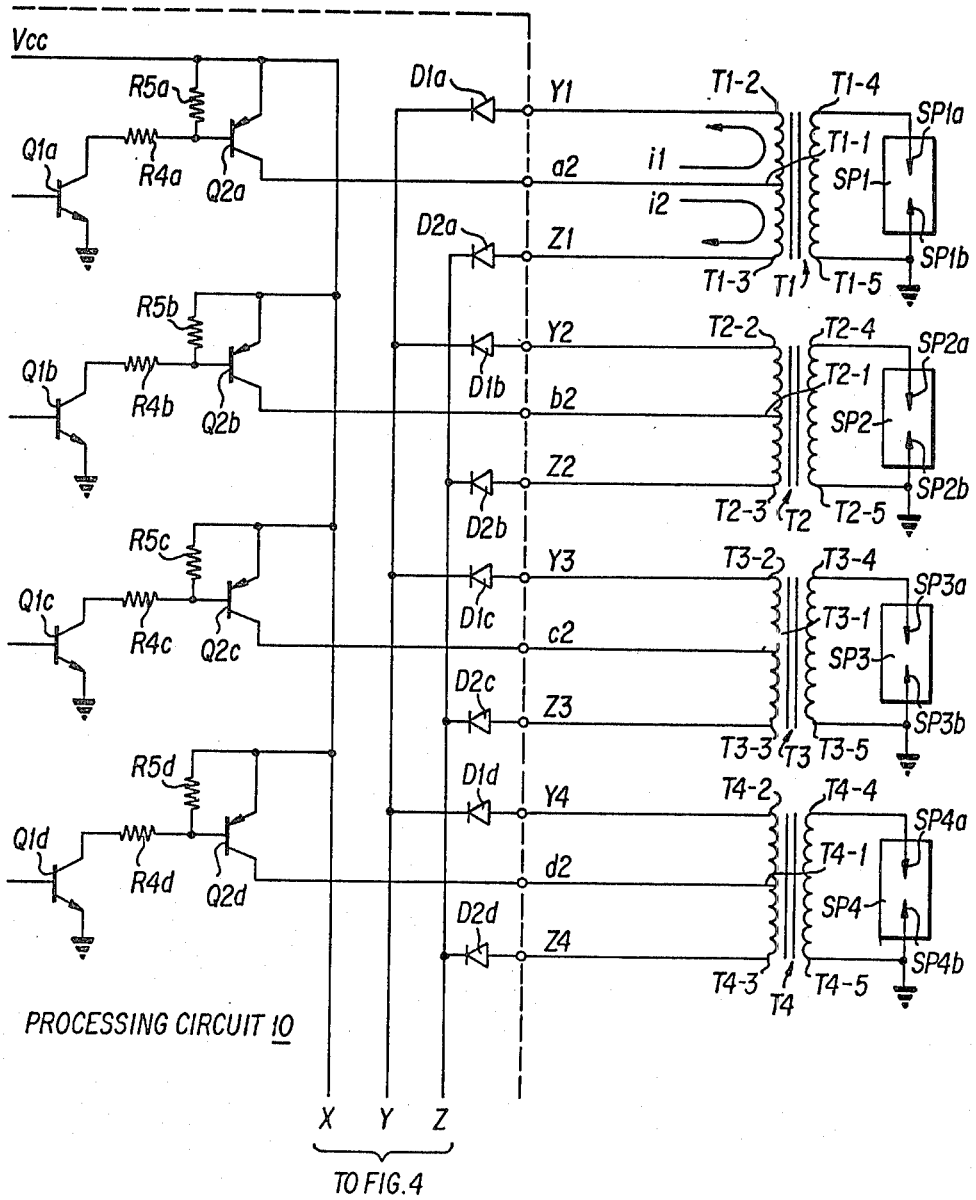
Figure 4:
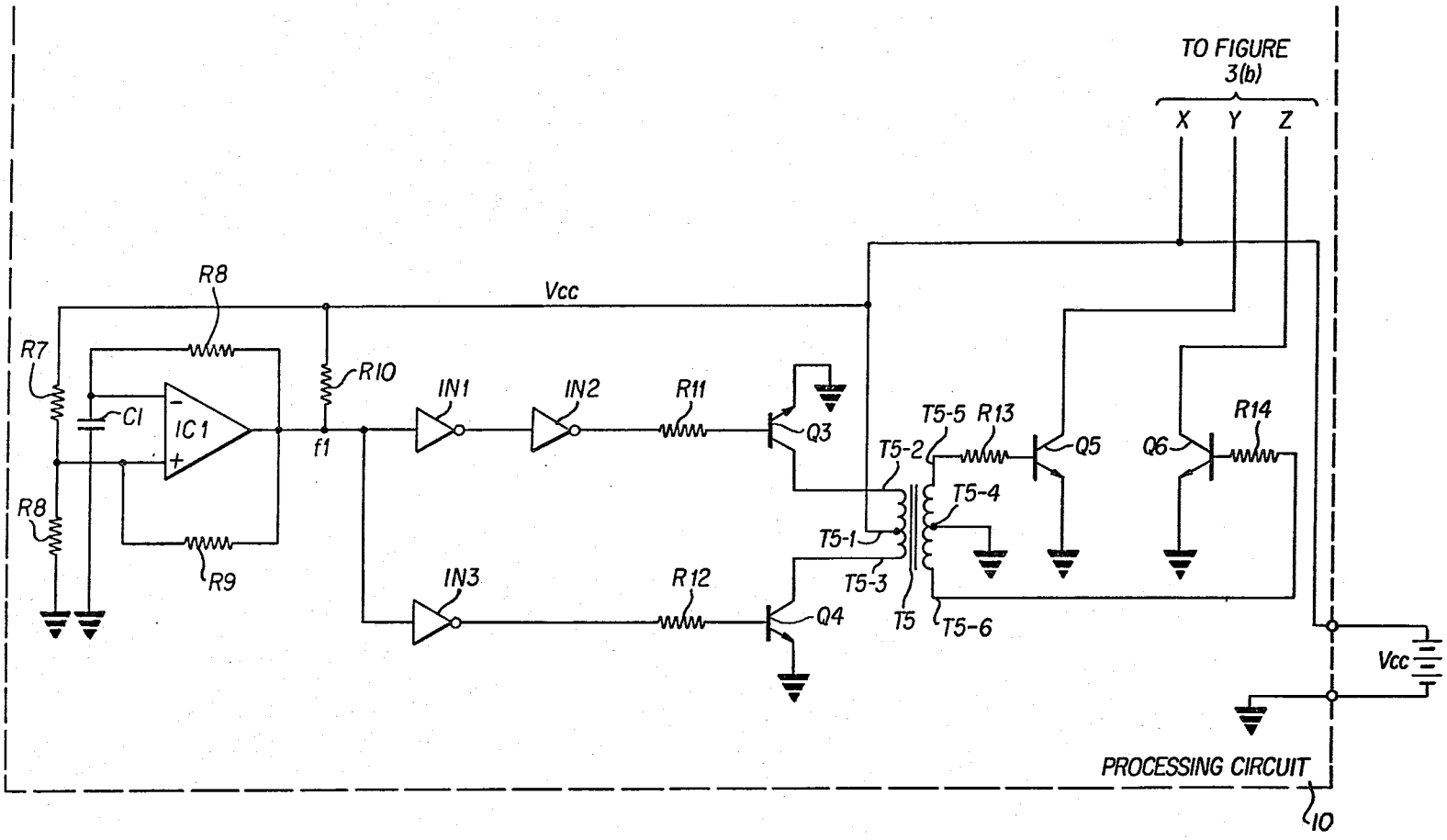

FIGS. 3 and 4 illustrate a schematic diagram of the ignition system according to the first preferred embodiment of the subject invention. The ignition system includes the four previously discussed photo-interrupters 4*a* through 4*d*, a processing circuit 10, four ignition transformers T1 through T4, and four spark plugs SP1 through SP4.

The four light emitting diodes LD1 through LD4 of the photo-interrupters 4*a* through 4*d* are each coupled between ground and a positive DC voltage Vcc (vehicle battery) through series resistors R1*a* through R1*d*, respectively. Thus, the light emitting diodes remain on constantly so long as power is applied to the ignition system.

The collector of each photo transistor, PT1 through PT4, in the photo-interruptors 4*a* through 4*d* is coupled to the positive DC voltage Vcc, while the emitters are each coupled to ground through series resistors R2*a* through R2*d*, respectively. The signal appearing at the emitter of each photo transistor is at a high level when the shutter 2 allows light from the light emitting diodes to strike the photo-transistors. Thus, emitter signals a1 through d1 (henceforth referred to as timing signals a1 through d1) of the photo-transistors PT1 through PT4 are normally low and take on a high level when the opening 3 in the shutter passes through the respective photo-interruptor.

The timing signal a1 is coupled through the series combination of an isolation amplifier Ia and a resistor R3*a* to the base of a transistor Q1*a* which becomes turned on when the timing signal a1 is high. The collector of transistor Q1*a* is coupled to the base of a transistor Q2*a* through a series resistor R4*a*. The resistor R4*a* combines with a resistor R5*a* to bias transistor Q2*a* which is normally turned off when the timing signal a1 is at the low level. When transistor Q1*a* turns on, transistor Q2*a* likewise turns on thereby coupling the battery voltage Vcc to its collector. The collector of transistor Q2*a* is coupled to the center tap T1-1 of the primary winding of the ignition transformer T1. Therefore, the center tap T1-1 is coupled to the battery voltage Vcc when the timing signal a1 is at a high level corresponding to the passage of the opening 3 of the shutter 2 through the photo-interrupter 4*a*. Similarly, the timing signals b1 through d1 of the photo-interrupters 4*b* through 4*d* are coupled through the processing circuit 10 to supply the battery voltage Vcc to the center taps T2-1 through T4-1 of the primary windings of the ignition transformers T2 through T4, respectively.

As shown in FIG. 4, the processing circuit 10 additionally includes an operational amplifier IC1 which is connected to operate as an oscillator of well known design producing a square wave output signal f1 having a frequency of approximately 20 kHz. The operational amplifier IC1 can be any standard type such as one of the common 741 series. The resistor R7 supplies the battery voltage Vcc to the positive input of the operational amplifier IC1 and thus provides an input for the oscillator. The resistors R6 and R9 form a positive feedback network for IC1. The frequency of the square wave output of IC1 is controlled by the time constant product R8C1 of the negative feedback circuit.

The oscillator output signal f1 is coupled through the series combination of two inverters, IN1 and IN2, and resistor R11 to the base of a transistor Q3. The inverters IN1 and IN2 act to isolate the oscillator circuit, including the operation amplifier IC1, so as to enhance the stability of the oscillator. The transistor Q3 turns on when the oscillator signal f1 is at a high level, thereby coupling the terminalT5-2 of the primary winding of interstage transformer T5 to ground. The transistor Q3 is turned off when the oscillator signal f1 is at its low level.

Additionally, the oscillator signal f1 is coupled through the series combination of inverter IN3 and resistor R12 to the base of transistor Q4. The inverter IN3 acts to invert the oscillator signal f1 and to isolate the oscillator circuit. As such, transistor Q4 turns on when the oscillator output signal f1 is at its low level, thereby connecting the other terminal T5-3 of the interstage transformer T5 to ground.

The primary terminal T5-3 of the transformer T5 is thus coupled to ground when the oscillator output signal f1 is low and the primary terminal T5-2 is coupled to ground when the signal f1 is high. Thus, since the center tap terminal T5-1 of the primary winding of transformer T5 is connected to the battery voltage Vcc, a current flows from the terminal T5-1 to the terminal T5-2 when the signal f1 is high, and a current flows from the terminal T5-1 to the terminal T5-3 when f1 is low. Due to the current flowing in the primary circuit, a potential is induced in the secondary winding of T5 such that the terminal T5-5 becomes positive with respect to the seconday center tap terminal T5-4, which is grounded, in synchronism with the positive pulses of the oscillator signal f1 while the terminal T5-6 of the secondary winding becomes positive in synchronism with the low levels of the signal f1.

The secondary terminal T5-5 is coupled through a series resistor R13 to the base of a transistor Q5 which turns on when the signal f1 is high, thereby coupling the signal line Y to ground. Similarly, the terminal T5-6 is coupled through the series resistor R14 to the base of a transistor Q6 which turns on thereby coupling the signal line Z to ground when the signal f1 is low. Thus the signal lines Y and Z are alternatingly grounded at the rate of approximately 20 kHz which is the frequency of the oscillator signal f1.

The signal line Y is coupled via the diodes D1*a* through D1*d* to the first terminals T1-2 through T4-2, respectively, of the primary windings of the ignition transformers T1 through T4. The signal line Z is similarly coupled via the diodes D2*a* through D2*d* to the other terminals T1-3 through T4-3, respectively, of the primary windings of the ignition transformers T1 through T4. Therefore, the opposite end terminals of the primary winding of each ignition transformer T1 through T4 are alternatingly grounded at the rate of 20 kHz.

As previously explained, the timing signals a1 through d1 act to couple the battery voltage Vcc to the center taps T1-1 through T4-4 of the ignition transformers T1 through T4 for a time duration and in a time sequence as determined by the rotation of the shutter 2 past the photo-interrupter 4*a* through 4*d*. This results in an alternating flow of current through the primary windings of the ignition transformers under the control of the timing signals a1 through d1. For example, when the timing signal a1 is at its high level and the signal line Y is grounded, a current $i_1$ flows through the primary winding of the ignition transformer from the battery Vcc through the center tap T1-1 to the end terminal T1-2 and thenceforth through the diode D1*a* to ground via the signal line Y. Similarly, when the timing signal a1 is high and the signal bus Z is grounded, a circuit $i_2$ flows from the battery Vcc through the terminals T1-1 and T1-3 of the transformer T1 to ground via the diode D2*a* and the signal line Z. Since the ignition transformer T1 (and transformers T2 through T4) is a high voltage step-up device having a turns ratio of approximately 3,000 to 1, the currents $i_1$ and $i_2$ act to induce high potentials in the secondary winding of the transformer. Thus, the current $i_1$ induces a high voltage in the secondary such that the terminal T1-4 becomes positive with respect to the terminal T1-5. When this voltage becomes sufficiently high, an arc occurs between the conductors SP1*a* and SP1*b* of the spark plug SP1 connected across the secondary terminals T1-4 and T1-5 of the ignition transformer T1. When the current $i_1$ ends and the current $i_2$ begins, the polarity of the induced voltage in the secondary winding reverses and the arc ends. The voltage of the terminal T1-5 thus becomes positive with respect to the terminal T1-4 and the spark plug reignites with an arc now flowing between the terminals SP1*b* and SP1*a*. Since the signal lines Y and Z are alternatingly grounded at the 20 kHz rate of the oscillator signal f1, the primary currents $i_1$ and $i_2$ alternate at the rate of 20 kHz and thus a plurality of arcs alternating at a 20 kHz rate occur within the spark plug terminals for the duration of the time in which the timing signal a1 is at the high level. A similar arc event occurs at the spark plugs SP2 through SP4 due to the timing signals b1 through d1, respectively.

Figure 5:
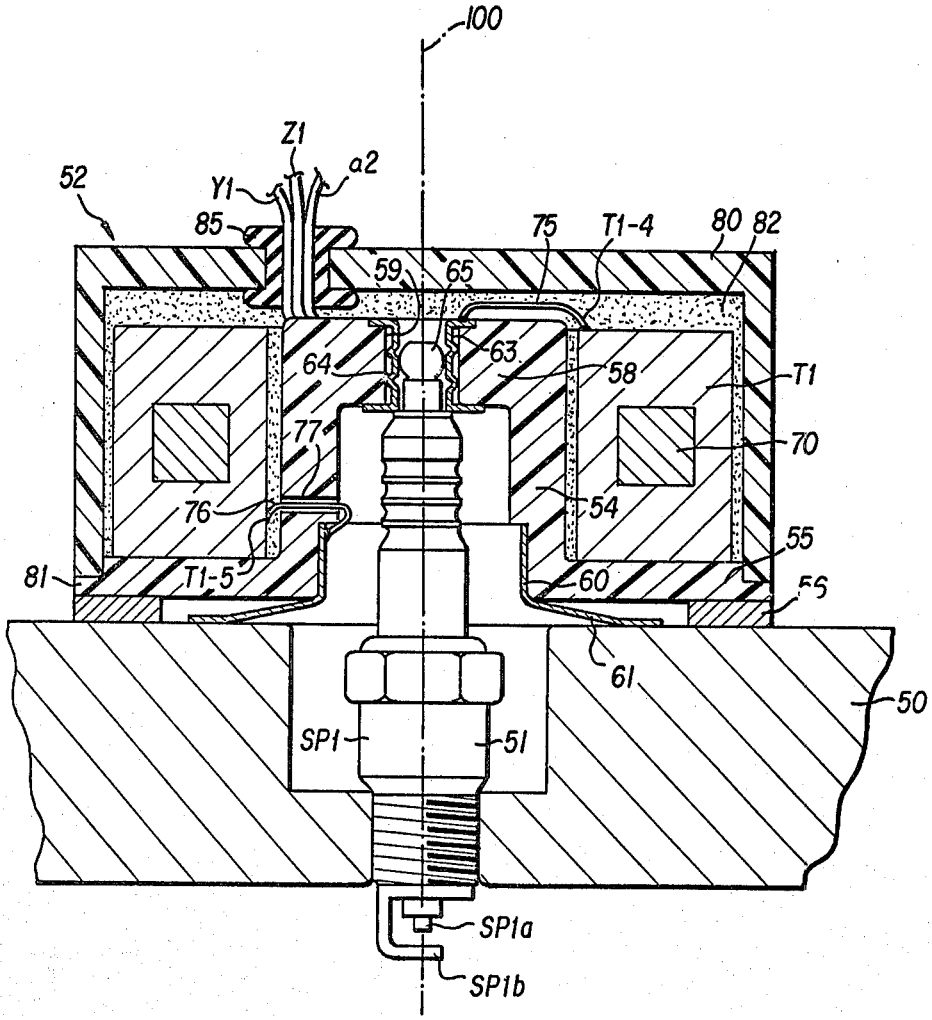
FIGS. 5 and 6 illustrate a combination ignition transformer and spark plug cover assembly according to the present invention.
Figure 6:
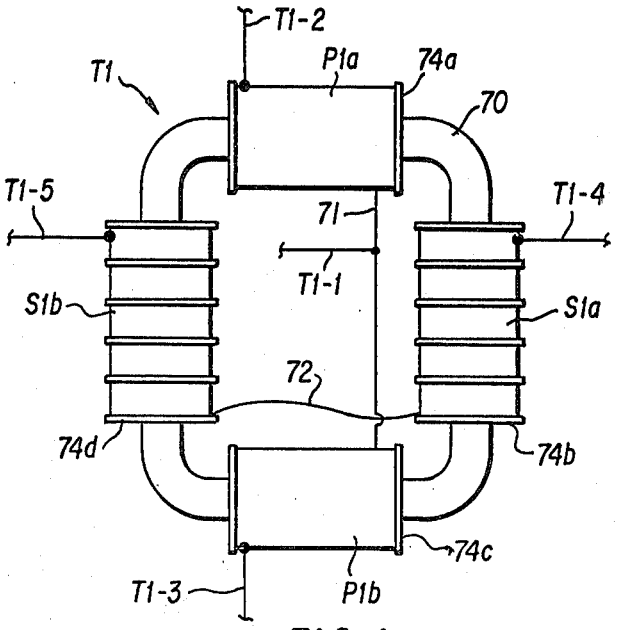

FIGS. 5 and 6 illustrate a preferred embodiment of a novel ignition transformer utilized with the ignition system of the subject invention. This device is utilized to form the ignition transformer T1 through T4 shown in FIG. 3. For convenience, the ignition transformer will be assumed to be transformer T1.

In FIG. 5, the spark plug SP1 including the plug contacts SP1*a* and SP1*b* is shown as being installed in the head 50 of an engine. Surrounding the portion 51 of the spark plug SP1 extending from the head 50 is a combination plug cover and ignition transformer assembly (hereinafter referred to as the combination assembly) generally designated as 52 and illustrated in cross-section. Positioned within the combination assembly 52 is a generally hollow cylindrical insulating member 54 which includes a flat circular base member 55 integrally attached to the base of the cylindrical member 54 and lying in a plane normal to the central axis 100 of the cylindrical member. A ring-shaped flange member 58 including a circular opening 59 therethrough is integrally attached to the upper portion of the cylindrical insulating member 54. The cylindrical member 54 and its integral base member 55 and flange member 58 are made from a strong, high dielectric strength material such as epoxy glass or silicone plastic.

Affixed to the lower surface of the base member 55 is a ring-shaped resilient gasket 56, made from silicone rubber or equivalent material, which forms a moisture proof seal with the external surface of the head 50. Additionally, affixed to the inner surface of the cylindrical member 54 is a cylindrical metal flange member 60 which includes an integral ring-shaped skirt 61. The flange member 60 and its skirt 61 are made from a springly conduction material such as a beryllium copper alloy. When the combination assembly 52 is in place surrounding the spark plug SP1, the skirt 61 is bent upward slightly by its contact with the surface of the head 50 and thus remains under tension thereby encouraging a good electrical contact with the head 50.

Positioned within the opening 59 in the flange member 58 and attached thereto is a generally cylindrical, hollow resilient terminal member 63 which includes a plurality of corrugations 64 in its cylindrical wall. The terminal member 63 is formed from a springy conductive metal such as the above-mentioned beryllium copper alloy. The terminal member 63 contacts the external surface of the upper terminal 65 of the spark plug SP1 and is removably affixed thereto due to the resilience of its material and the corrugations 64. The contact between the terminal member 63 and the upper terminal 65 of the spark plug acts to locate and hold the combination assembly 52 in place.

Located concentric with the cylindrical member 54 and resting on the upper surface of the flange member 55 is the ignition transformer T1. A top view of the transformer T1 is illustrated in FIG. 6. The transformer includes a generally rectangular core 70 having a square cross-section. The core is made from high permeability material such as ferrite or is formed from a plurality of turns of a magnetically soft amorphous metal tape. Wound about the core 70 are the primary and secondary windings P1 and S1. Each winding P1, S1 has been divided into two coils P1*a*, P1*b* and S1*a*, S1*b*, respectively, for reasons of space utilization. Thus primary coils P1*a* and P1*b* are joined by a jumper 71, and the secondary coils S1*a*, S1*b* are joined by a jumper 72. The coils are wound on conventional high dielectric strength bobbins 74*a* through 74*d* as is well known in the art.

Returning to FIG. 5, the first terminal T1-4 of the secondary winding of the ignition transformer T1 is coupled to the terminal member 63 by means of a jumper 75 attached thereto be welding or soldering. Similarly, the second terminal T1-5 is coupled to the resilient flange member 60 by means of a jumper 76 attached thereto by welding or soldering. The jumper 76 passes through a hole 77 in the cylindrical member 54 as shown.

The entire combination assembly 52 is surrounded by a cover 80 made from a strong, high dielectric strength material such as epoxy glass or silicone plastic. The cover 80 is bonded to a lip 81 of the base member 55 thereby sealing the combination assembly 52 against moisture. Spaces within the interior of the cover 80 are filled with a potting material 82 such as silicone rubber. The primary leads Y1, Z1 and a2 enter the combination assembly 52 through a grommet 85 positioned within an opening in the cover 80.

The combination spark plug cover and ignition transformer assembly 52, as shown in FIG. 5, provides distinct advantages when used in conjunction with an ignition circuit such as that shown in FIGS. 3 and 4. Since the ignition transformer is positioned immediately adjacent to the spark plug it serves, all high voltage wires are eliminated along with their well known problems such as high voltage leakage and radio frequency interference (RFI). The power and control conductors for the ignition transformer all carry low voltages. Thus moisture and dirt related problems are virtually eliminated and radio frequency interference problems are substantially reduced. The interference problems can be further reduced by twisting and/or shielding the power and control leads. Furthermore, since the high voltage leads are eliminated, the rise time of the arc current within the spark plug can be greatly improved because the inductive and capacitive effects of the high voltage leads no longer exist. Additionally, the use of the continuous rectangular core within the ignition transformer results in a reduction in radio frequency interference problems due to the inherent self-shielding properties of toroidal-shaped coils.

Next, a second preferred embodiment of an ignition system according to the present invention will be described with reference to FIGS. 7 through 10. Portions of this system are identical to the previously discussed system and are designated with the same reference numerals previously utilized.

Figure 7:
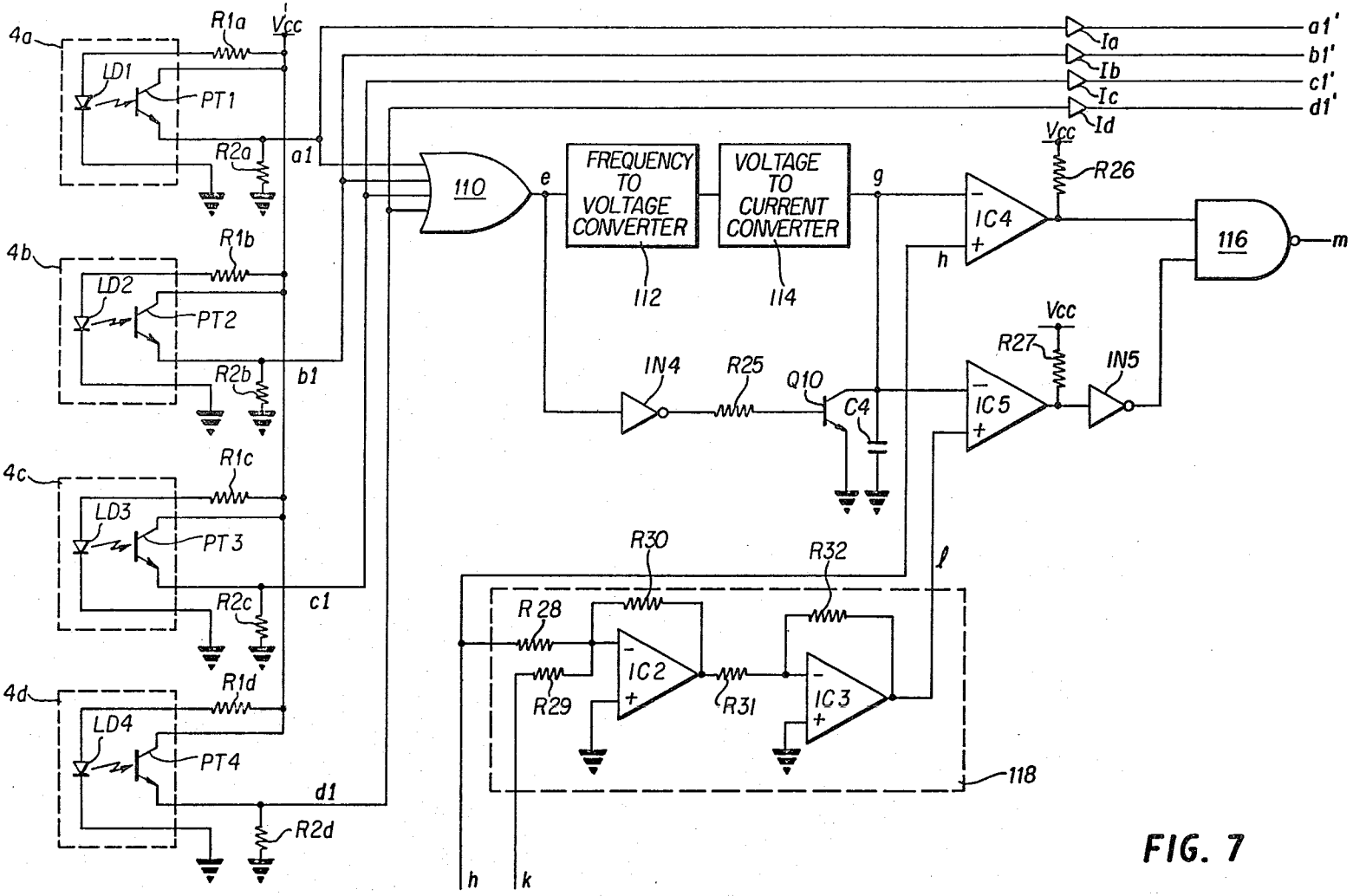
FIGS. 7 and 8 illustrate a second preferred embodiment of an ignition system according to the present invention.

In FIG. 7, the four photo-interrupters 4*a* through 4*d* produce the four timing signals a1 through d1. The timing signals determine which spark plug is to be ignited. The time sequence of the timing signals a1 through d1 is illustrated in the timing chart of FIG. 10. The timing signals a1 through d1 pass through four buffer amplifiers Ia through Id to produce the buffered timing signals a1′ through d1′ which are essentially identical to the timing signals a1 through d1.

Additionally, the timing signals a1 through d1 are coupled to the input of an OR gate 110. The output signal e of the OR gate is at a high level when any of the timing signals a1 through d1 is high as shown in the timing diagram of FIG. 10. The signal e is coupled to a frequency to voltage converter 112 which produces an output signal having a voltage proportional to the frequency of the signal e. The output of the frequency to voltage converter 112 is coupled to the input of a voltage to current converter 114 which produces a current proportional to the output of the frequency to voltage converter 112. Thus the output current of the converter 114 is proportional to the frequency of the signal e and thus is proportional to the speed of rotation of the engine.

Figure 10:
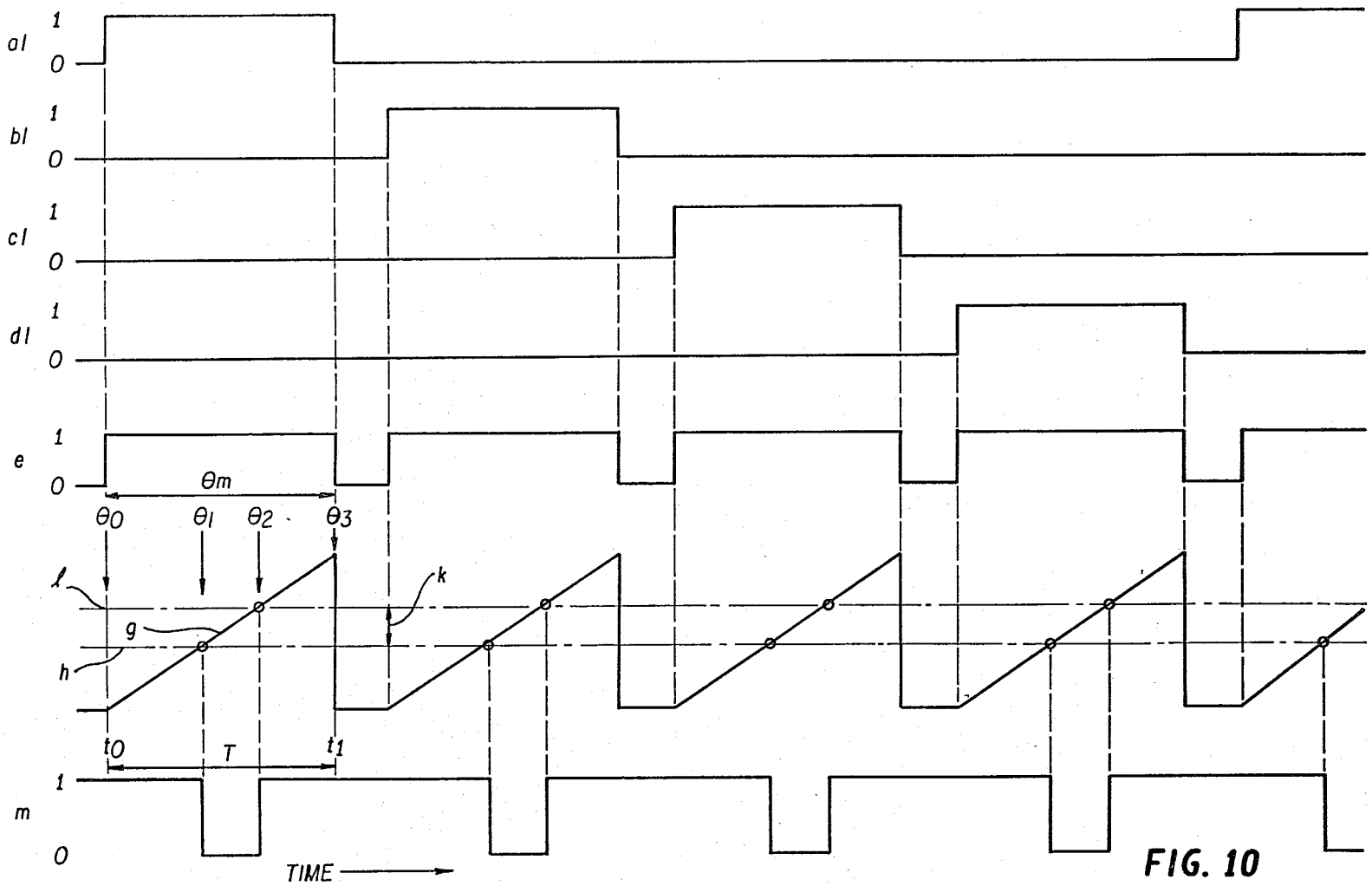
FIG. 10 is a timing chart illustrating various waveforms appearing in the ignition system shown in FIGS. 7 and 8.

The output current of the voltage to current converter 114 is coupled to a capacitor C4 which is charged by the current to produce a voltage signal g as shown in the timing chart of FIG. 10. The signal e is, additionally, coupled through the series combination of an inverter IN4 and a resistor R25 to the base of a transistor Q10 which shunts the capacitor C4. The capacitor C4 is shorted by the transistor Q10 when the signal e is at a low level indicating that the timing signals a1 through d1 are at the low level. The capacitor C4 is allowed to charge only when one of the timing signals a1 through d1 is high. Thus the voltage signal g is a saw tooth waveform which starts at time t0 and ends at time t1 as shown in FIG. 10. Since the time (t1-t0) is inversely proportional to the frequency of the signal e and the time rate of increase of the voltage g is directly proportional to the frequency of the signal e, the saw tooth waveform g maintains a constant shape regardless of the frequency of the signal e or regardless of the rotational speed of the engine. The amplitude of the waveform g at any particular time represents an angle of rotation of the shutter 2 beginning with $\theta 0$ when the leading edge 3′ of the opening 3 passes through the center of the photo-interrupter and ending with $\theta 3$ when the trailing edge 3″ of the opening 3 passes through the photo-interrupter as shown in FIGS. 1 and 10.

Returning to FIG. 7, the sawtooth signal g is coupled to a first comparator IC4 where it is compared to a voltage h and is coupled to a second comparator IC5 where it is compared to a voltage l. The first comparator IC4 produces an output of "1" when $g<h$ and an output of "0" when $g>h$. Similarly, the second comparator IC5 produces an output of "1" when $g<l$ and an output of "0" when $g>l$. The output of the first comparator IC4 is coupled to the input of a NAND gate 116; while the output of the second comparator IC5 is coupled through an inverter IN5 to an input of the NAND gate 116. The output m of the NAND gate 116 is normally "1" and becomes "0" only when the condition $h<g<l$ exists.

Reference numeral 118 represents an adder circuit, including operational amplifier IC2 and IC3, which generates the voltage l by adding the voltage h to a voltage k ($l=h+k$).

As will be described in detail below, when the output of the NAND gate 116 becomes "0" one of the spark plugs SP1 through SP4 is ignited. The starting point of the ignition in the angle $\theta 1$ shown in FIG. 10 which corresponds to the rotational angle through which the leading edge 3′ of the shutter 2 has rotated since the edge 3′ passed through the photo interrupter. Thus the voltage h determines the rotational angle of the crankshaft at which the spark ignition begins and thus the ignition advance of the engine. Similarly, the angle $\theta 2$ represents the end of the ignition pulse as determined by the voltage l. Thus the angular duration of the ignition is $\theta_2$-$\theta_1$ and is determined by the voltage $k(=l-h)$. In FIG. 1, the symbols A through D represent the top dead center points of the engine. The angle $\theta_m$ represents the angle between the top dead center A and the center of the photo-interrupter 4*a* and is generally known as the maximum advanced position. In FIG. 10, $\theta_3-\theta_0(=\theta_m)$ represents the angular opening 3 in the shutter 2. Thus the angle $\theta_3-\theta_1$ represents the advance of the engine. Therefore, when $\theta_1$ is determined, by the voltage h, the general "advance" of the engine can be determined.

The voltage h which determines the advance of the engine and the voltage k which determines the duration of the ignition are inputs to the ignition system of the subject invention. These inputs may be fixed voltages or they may be variable based upon certain of the operating parameters of the engine, such as manifold vacuum, torque, speed, as is well known in the art.

Figure 9:
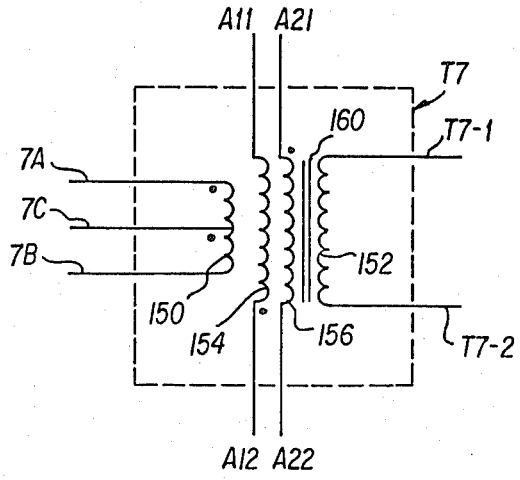
FIG. 9 illustrates an ignition transformer for use with the ignition system shown in FIGS. 7 and 8.
Figure 8:
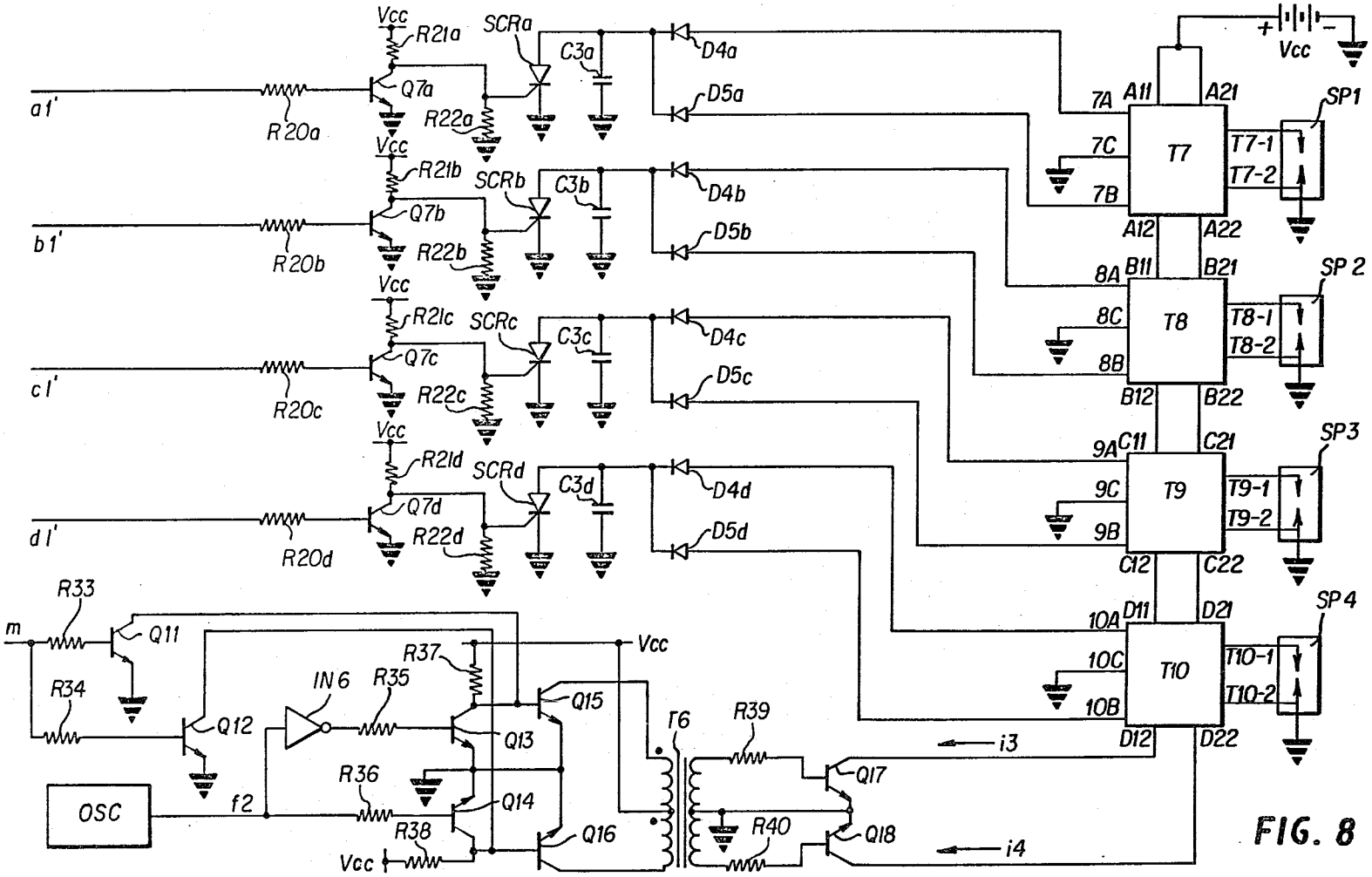

Referring now to FIG. 8, the buffered timing signals a1′ through d1′ are coupled through resistors R20*a* through R20*d*, respectively, to the bases of transistors Q7*a* through Q7*d*, respectively. The transistors Q7*a* through Q7*d* are individually turned on when the respective timing signal a1 through d1 is at its high level. For example, when the timing signal a1 is high, transistor Q7*a* is turned on and the silicon controlled rectifier SCRa, coupled to the collector of Q7*a*, is turned off. When SCRa is off, ignition is possible in the cylinder served by spark plug SP1. On the other hand, when the timing signal a1 is at its low level, transistor Q7*a* is turned OFF and the SCRa is turned on. When SCRa is turned on, conductors 7A and 7B are grounded through the diodes D4*a* and D5*a* thereby grounding the end terminals of the center tapped control coil 150 in the ignition transformer T7. FIG. 9 illustrates the electrical structure of the ignition transformer T7 which will be discussed further below. The ignition transformers T7 through T10 are identical. When the control coil 150 of ignition transformer T7 is grounded via SCRa, changes in the magnetic flux in the ignition transfomer's core 160 are prevented thereby preventing the induction of high voltage into the secondary winding 152. The other ignition transformers T8 through T10 are controlled via SCRb through SCRd, respectively.

As seen in FIG. 10, only one timing signal a1 through d1 is at a high level at any particular time. Thus all the control coils in the ignition transformers T7 through T10 are grounded except for one as determined by the high timing signal. Thus a high voltage can only be induced in the secondary winding of the ignition transformer controlled by the high timing signal.

The capacitors C3*a* through C3*d* and the diodes D4*a* through D4*d* and D5*a* through D5*d* function as smoothing circuits for the silicon controlled rectifiers SCRa through SCRd.

The output m of the NAND gate 116 is coupled through resistors R33 and R34 to the bases of a pair of transistors Q11 and Q12. The collectors of Q11 and Q12 are respectively coupled to the bases of transistors Q15 and Q16. When the NAND gate output m is high, the transistors Q11 and Q12 are turned ON thereby forcing the transistors Q15 and Q16 to be OFF.

An oscillator 118 generates a square wave signal f2 having a frequency of between 15 and 30 kHz. The square wave signal f2 is coupled to the base of a transistor Q14 through a resistor R36 and to the base of a transistor Q13 through an inverter IN6 and a resistor R35. The transistors Q13 and Q14 thus alternatingly turn on and off at the frequency of the square wave signal f2. The collectors of transistors Q13 and Q14 are coupled to the bases of transistors Q15 and Q16, respectively, thereby alternatingly turning the transistors Q15 and Q16 ON and OFF at the rate of signal f2 when the signal m is at its low level. As previously mentioned, the transistors are turned off or inhibited when the signal m is high. When the signal m is low, the square wave signal is coupled from the alternating transistors Q15 and Q16 through the transformer T6 to the bases of transistors Q17 and Q18 which alternatingly turn on and off with the signal f2.

The collectors of transistors Q17 and Q18 are coupled to one end of the respective primary windings 154 and 156 of the ignition transformers T7 through T10 which are connected in series as shown in FIGS. 8 and 9. The other ends of the primary windings 154 and 156 are coupled to the battery Vcc. Thus when the signal m is low, the transistors Q17 and Q18 alternatingly conduct currents 13 and 14, respectively from the battery Vcc to ground through the primary windings 154 and 156. When one of the timing signals a1 through d1 is high, the control winding 150 of the ignition transformer associated with the high timing signal is open circuited thereby enabling the transformer. The alternating currents i3 and i4, occurring when m is low, act to induce a high voltage into the secondary winding 152 of the ignition transformer associated with the high timing signal thereby causing the spark plug attached to the secondary winding to ignite.

As seen in FIG. 9, the primary windings 154 and 156 of the ignition transformer are wound in opposite directions in the transformer's core. Thus when the transformer is enabled via the control winding 150 and when the currents i3 and i4 are flowing, an alternating voltage is induced into the secondary 152 having a frequency equal to that of the oscillator square wave output signal f2. Since the ignition transformer has a primary to secondary turns ratio of 1 to 3000, the alternating voltage has a very high amplitude which causes the spark plug connected to the transformer to repeatedly arc at the rate of the frequency of the signal f2. The ignition transformers T7 through T10 are similar in structure to the combination ignition transformer and spark plug cover assembly shown in FIGS. 5 and 6 with the addition of an extra primary winding and the control winding. The numerous advantages provided by the combination assembly are equally applicable to the present embodiment of the ignition system.

Obviously, numerous modifications and variations of the present invention are possible in light of the above teachings. It is therefore to be understood with within the scope of the appended claims, the invention may be practiced otherwise than as specifically described herein.

What is claimed as new and desired to be secured by Letters Patent of the United States is:

1. An ignition system for an internal combustion engine, comprising:

crankshaft position sensor means coupled to a crankshaft of said engine for sequentially supplying an output signal to each of a plurality of output terminals in synchronism with the rotation of said crankshaft, one of said output terminals being associated with each cylinder of said engine;

a plurality of switch means, each of said switch means being coupled to receive said output signal from one of the output terminals of said position sensor means for coupling a first and second output terminal of said each of said switch means to ground each time said output signal is received from said position sensor means;

ignition timing generator means coupled to receive said output signal from each of said output terminals of said position sensor means for integrating over time each of said output signals appearing at each of said output terminals of said position sensor means and for generating an ignition pulse during the period of each output signal received from said position sensor means, said ignition pulse beginning when the results of each of said integrations over time reaches a first predetermined value and ending when the results of each integration reaches a second predetermined value;

oscillator means for producing an AC output signal;

control means coupled to receive said AC output signal from said oscillator means and coupled to receive said ignition pulse generated by said timing generator means for alternatingly grounding a first and second output terminal of said control means in synchronism with said AC oscillator output signal during the period of said ignition pulse;

a plurality of high voltage generator means, one of said high voltage generator means being associated with each cylinder of said engine, each of said high voltage generator means being coupled to said first and second terminals of one of said switch means and coupled to said first and second output terminals of said control means for generating a high voltage signal at an output terminal when said first and second terminals of said switch means are grounded simultaneously with the grounding of said first output terminal or said second output terminal of said control means;

a plurality of spark plug means, one of said spark plug means being associated with each cylinder of said engine, each spark plug means being coupled to receive the high voltage output of one of said high voltage generator means for producing an arc upon receipt of said high voltage output.

2. An ignition system as recited in claim 1, wherein said position sensor comprises:

a shutter coupled to rotate in synchronism with said crankshaft, said shutter including an opening therein;

a plurality of photo-interrupters positioned about said shutter, each photo-interrupter including a light source located adjacent to a first side of said shutter and a light sensor means located adjacent to said light source and adjacent to a second side of said shutter for producing an output when said opening in said shutter passes between said light source and said light sensor means; and amplifier means coupled to receive the output signal from each light sensor means in each photo-interrupter for supplying said output signal to one of said output terminals of said positions sensor means each time an output is received from one of said photo-interrupters.

3. An ignition system for an internal combustion engine as recited in claim 1, wherein each of said high voltage generator means comprises:

an ignition transformer, said transformer including a high permeability toroidal core, said transformer including a control winding wound on said core and coupled to said first and second terminals of one of said switch means, said transformer including first and second primary windings and a secondary winding wound on said core, a first terminal of said first and second primary windings being coupled to a source of DC power, a second terminal of said first primary winding being coupled to said first output terminal of said control means, a second terminal of said second primary winding being coupled to said second output terminal of said control means, said secondary being coupled to said spark plug means.

* * * * *

UNITED STATES PATENT AND TRADEMARK OFFICE

CERTIFICATE OF CORRECTION

PATENT NO. : 4,432,323

DATED : FEBRUARY 21, 1984

INVENTOR(S) : SHINICHIRO IWASAKI

It is certified that error appears in the above-identified patent and that said Letters Patent is hereby corrected as shown below:

Column 1, lines 25-26, "air to fuel" should read --fuel to air--.

Column 4, line 45, "seconday" should be --secondary--.

Column 5, line 5, "T4-4" should be --T4-1--.

Column 6, line 5, "gasket 56" should be --gasket member 56--.

Column 6, line 13, "springly" should be --springy--.

Column 6, line 51, "be" should be --by--.

Column 9, line 60, "13 and 14" should be --i3 and i4--.

Column 11, line 16, please insert "means" between "sensor" and "comprises".

Signed and Sealed this

Tenth Day of July 1984

[SEAL]

*Attest:*

GERALD J. MOSSINGHOFF

*Attesting Officer*

*Commissioner of Patents and Trademarks*